US008757647B1

(12) United States Patent
Su

(10) Patent No.: US 8,757,647 B1
(45) Date of Patent: Jun. 24, 2014

(54) ASSEMBLING STRUCTURE OF SUPPORT BRACKET AND WHEEL AXLE OF SKATEBOARD

(71) Applicant: Yuche Su, Taipei (TW)

(72) Inventor: Yuche Su, Taipei (TW)

( * ) Notice: Subject to any disclaimer, the term of this patent is extended or adjusted under 35 U.S.C. 154(b) by 0 days.

(21) Appl. No.: 13/909,052

(22) Filed: Jun. 3, 2013

Related U.S. Application Data

(60) Provisional application No. 61/851,780, filed on Mar. 13, 2013.

(51) Int. Cl.
*B62M 1/00* (2010.01)

(52) U.S. Cl.
USPC ..... 280/87.042; 280/11.19

(58) Field of Classification Search
USPC ..... 280/87.042, 11.27–11.28, 11.19
See application file for complete search history.

(56) References Cited

U.S. PATENT DOCUMENTS

| | | | | |
|---|---|---|---|---|
| 6,761,369 | B1 * | 7/2004 | Anderson | 280/87.042 |
| 6,793,224 | B2 * | 9/2004 | Stratton | 280/87.042 |
| 7,104,558 | B1 * | 9/2006 | Saldana | 280/87.042 |
| 7,364,774 | B2 * | 4/2008 | Urscheler et al. | 427/420 |
| 2011/0095596 | A1 * | 4/2011 | King | 301/37.101 |

* cited by examiner

*Primary Examiner* — John Walters
*Assistant Examiner* — James Triggs
(74) *Attorney, Agent, or Firm* — Leong C. Lei

(57) ABSTRACT

A skateboard includes a support bracket mounted to an underside of the skateboard, a retention ring, and a wheel axle to which wheels are mounted. The support bracket has an axle hole that includes an internally threaded section and a groove. The retention ring is capable of elastic deformation. The wheel axle has an end that includes an externally threaded section and a retention slot. Through the threading engagement between the internally threaded section and the externally threaded section, the end of the wheel axle is fastened in the axle hole. With the retention ring retained between the groove and the retention slot by having a portion of the ring received in the groove and another portion received in the retention slot, the end of the wheel axle is retained in the axle hole without axial movement.

4 Claims, 4 Drawing Sheets

ASSEMBLING STRUCTURE OF SUPPORT BRACKET AND WHEEL AXLE OF SKATEBOARD

(A) TECHNICAL FIELD OF THE INVENTION

The present invention generally relates to the field of skateboard, and more particular to an assembling structure of support bracket and wheel axle of skateboard that allows a skateboard wheel axle to be coupled to a support bracket by means of threading engagement and retaining engagement without being axially movable so as to ensure the advantages of improved stability of skateboard, increased speed being available, safer and more precise operation, reduced manufacturing cost, being free of undesired separation of wheel axle from skateboard, and aesthetically improved outside appearance.

(B) DESCRIPTION OF THE PRIOR ART

A skateboard is a carrier structure that allows a user to stand thereon and is propelled by the feet of the user to provide the effect of exercise. The operation of the skateboard is realized by inclining and swinging the user's body or through the user running up to achieve skid of the board. It can be used as a transportation means or entertainment device through the skidding movement thereof. Also, difficult or advanced operations, such as sky turning, which are commonly seen in games or competitions, have been developed for the skateboard exercise. The skateboard is now prevailing for all ages in the European and American areas. With the skateboard sports being widely spread overall the world, the local population of skateboard fans is increasingly expanded.

The general structure of skateboards, either those used aboard or domestic skateboards, comprises a board having an underside to which two support brackets respectively mounted to the fore portion and the hind portion. The support brackets are each provided with symmetrically arranged left-side and right-side wheels through the use of a threaded bar (which is the wheel axle of the skateboard). Such a structure of the skateboard may meet the requirement of allowing a user to stand on the board with the skateboard being propelled by the feet of the user, but there are drawbacks of the support bracket and the threaded bar.

The drawbacks of the support bracket will be explained first. One of the currently available skateboard comprises a support bracket that receives a threaded bar to extend therethrough and two wheels are fastened to opposite ends of the threaded bar. The threaded bar is generally very long, making it hard to keep straight and easily deflecting. Consequently, fast wear of the wheels may result and the skidding speed of the skateboard is reduced.

Next, the drawbacks of the threaded bar will be discussed.

(1) One of the commonly seen structures of skateboard requires the support bracket to be heated and thus expanded first and then each one of two opposite ends of the support bracket is inserted with a threaded bar. Through the principle of thermal expansion and cold shrinkage, the threaded bars can be fixed after the support bracket is cooled down. Such an operation of assembling suffers the problem of high cost.

(2) As an alternative to the solution of (1), the threaded bars can be mounted to the two ends of the support bracket by bonding with adhesive. The mechanical strength of adhesive bonding is generally poor and, consequently, the threaded bars are easily detached and falling out. This affects the operation safety of the skateboard.

(3) In one of the commonly seen structures of skateboard, pins are used to joint the support bracket and the threaded bars. This solution may affect the aesthetic appearance and may lead to easy detaching and falling and eventually affecting the operation safety of the skateboard.

Apparently, the conventional assembling structure of support bracket and threaded bar (namely skateboard wheel axle) of skateboard is generally not perfect and must be further improved.

The present invention aims to provide a technical solution to overcome such problems.

SUMMARY OF THE INVENTION

An object of the present invention is to provide an assembling structure of support bracket and wheel axle of skateboard, which fixes the skateboard wheel axle to the support bracket, without axial movement, by means of threading engagement and retaining engagement.

To achieve the above object, the present invention provides a structure that comprises a support bracket, a retention ring, and a wheel axle. The support bracket is mounted to an underside of the skateboard and comprises at least one axle hole. The axle hole comprises therein an internally threaded section and a groove formed at a predetermined location. The retention ring is of predetermined elasticity to enable predetermined deformation. The wheel axle has an end portion that forms an externally threaded section and a retention slot formed in an outer surface of the axle at a predetermined location. Another end portion of the wheel axle is mounted to a wheel. The externally threaded section of the wheel axle is set in threading engagement with the internally threaded section of the axle hole in such a way that the retention ring is retained between the groove and the retention slot by having a portion of the retention ring received in the groove and another portion received in the retention slot, whereby an end portion of the wheel axle is fixed in the axle hole, without axial movability, by means of threading engagement and retaining engagement. As such, the skateboard may ensures the advantages of improved stability of skateboard, increased speed being available, safer and more precise operation, reduced manufacturing cost, being free of undesired separation of wheel axle from skateboard, and aesthetically improved outside appearance.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
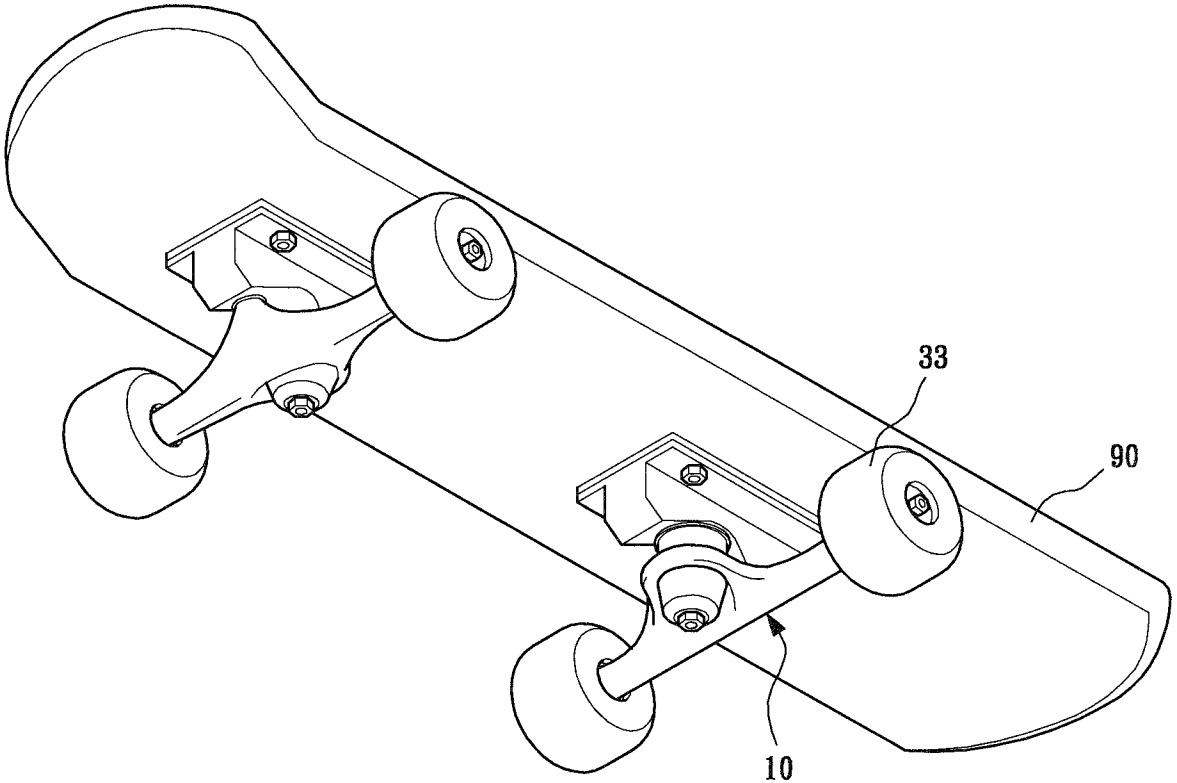
FIG. 1 is a perspective view of the present invention.
Figure 2:
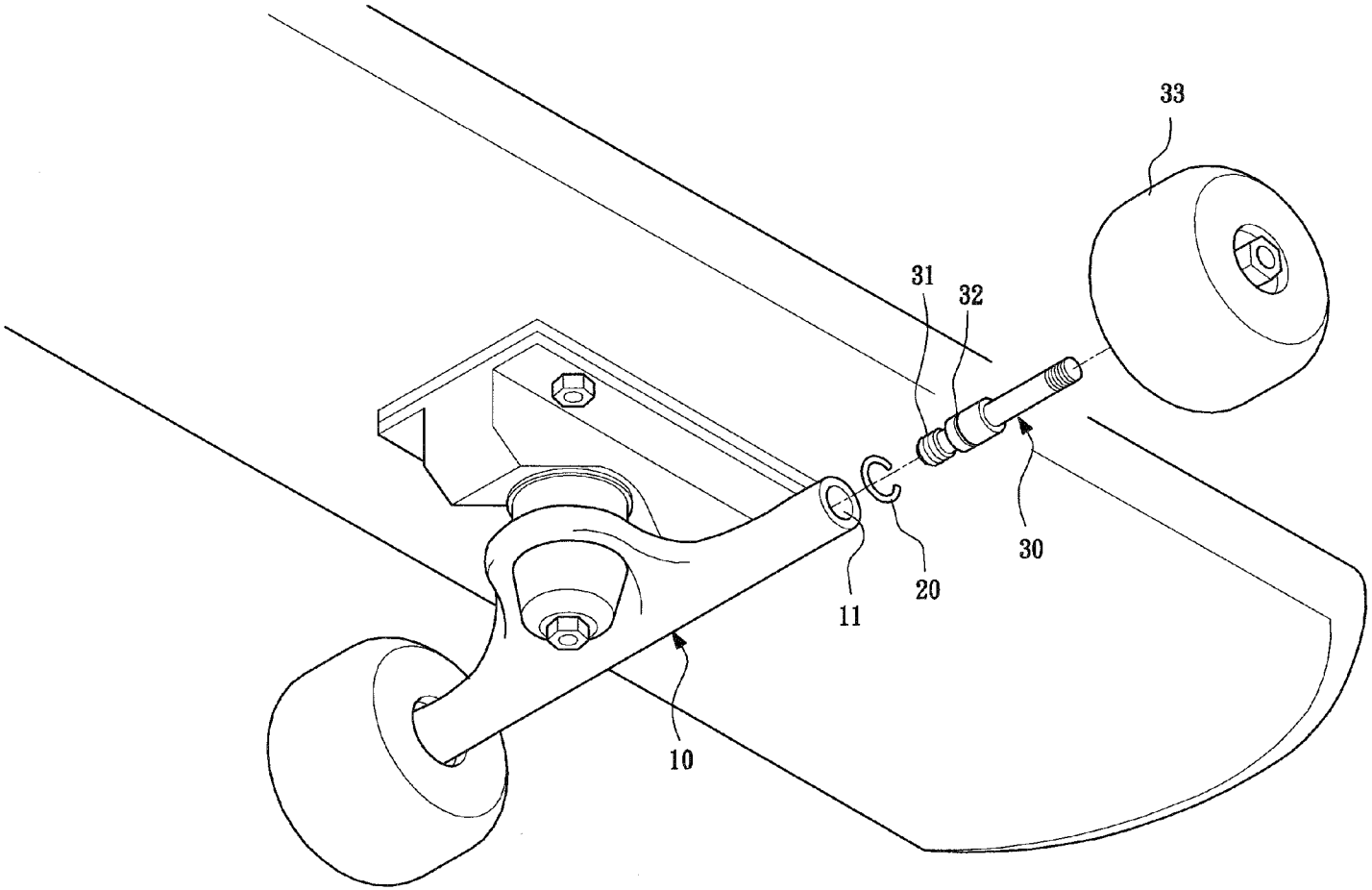
FIG. 2 is an exploded view of the present invention.
Figure 5:
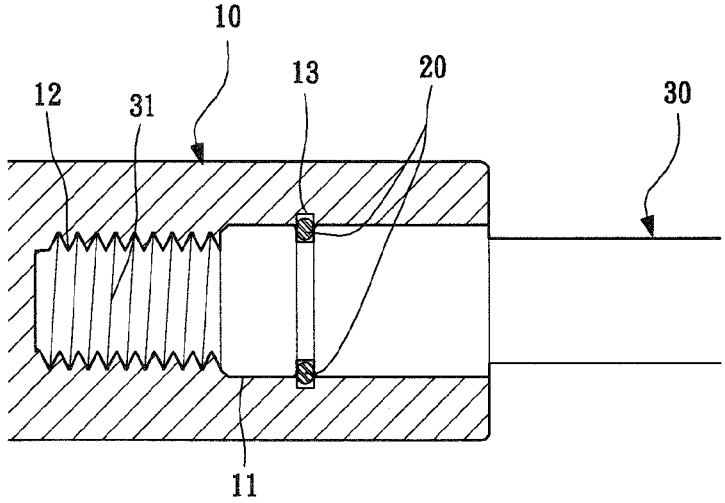
FIG. 5 is a cross-sectional view showing a support bracket and a wheel axle after being assembled.

Referring to FIGS. 1, 2, and 5, a preferred embodiment of the present invention comprises a support bracket 10, a retention ring 20, and a wheel axle 30 that are arranged to have the support bracket 10 and the wheel axle 30 to threadingly couple to each other. Further, the retention ring 20 is set, in a retaining manner, between the support bracket 10 and the wheel axle 30 to have an end portion of the wheel axle 30 retained in the support bracket 10 with no axial movement therebetween. As such, various advantages can be achieved, including improved stability of the skateboard, increased speed being available, safer and more precise operation, reduced manufacturing cost, being free of undesired separation of the wheel axle from the skateboard, and aesthetically improved outside appearance.

Figure 3:
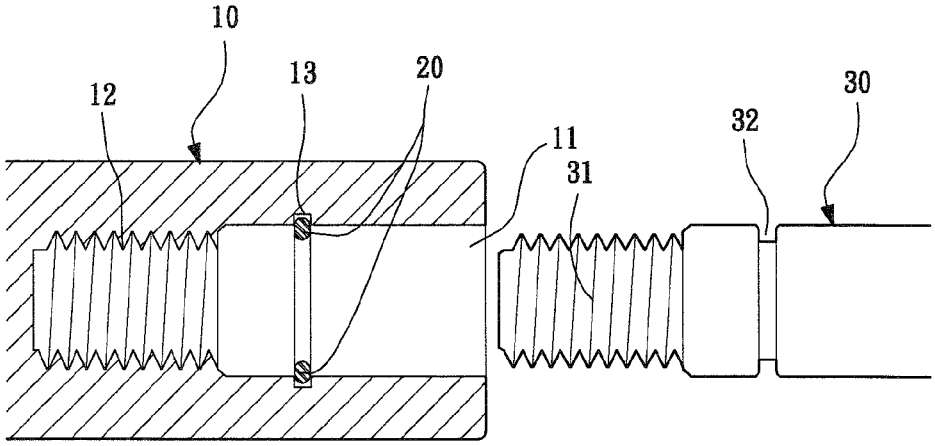
FIG. 3 is a cross-sectional view showing a support bracket and a wheel axle before being assembled.

Referring to FIGS. 2 and 3, the support bracket 10 of the present invention has two ends each forming an axle hole 11. The axle hole 11 comprises an internal threaded section 12 and a groove 13 formed therein at a predetermined location. The support bracket 10 is mounted to an undersurface of a skateboard 90. The mounting arrangement between the skateboard 90 and the support bracket 10 is well known and constitutes no novel part of the present invention, so that further details will not be described herein. Further, the two ends of the support bracket 10 respectively receive a wheel axle 30 coupled thereto with substantially identical assembling structures, so that in the following description, only one of the wheel axles 30 that is assembled to one of the ends of the support bracket 10 will be descried. The description is equally applicable to the other wheel axle.

The retention ring 20 is of predetermined elasticity that enables predetermined deformation of the ring and has a size receivable into the groove 13 in such a way that a ring body of the retention ring 10 partially projects outside the groove 13.

The wheel axle 30 has an end portion that forms an externally threaded section 31 threadingly engageable with the internally threaded section 12 and a retention slot 32 formed in an outside surface thereof at a predetermined location. The wheel axle 30 has an opposite end portion to which a wheel 33 is mounted. The coupling between the wheel 33 and the wheel axle 30 is well known and concerns no novel part of the present invention, so that no further details will be given herein.

The components/parts of the present invention have been described above and the operation, principle, and effectiveness of assembling thereof will be described next.

Referring to FIG. 3, the retention ring 20 is first disposed in the groove 13 inside the axle hole 11 and the retention ring 20 partially projects outside the groove 13 to provide a function of retaining.

Figure 4:
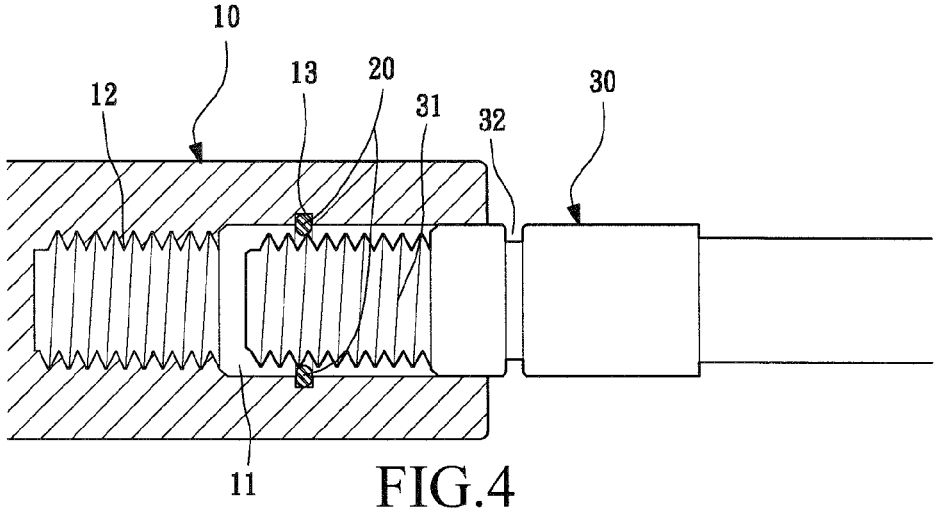
FIG. 4 is a cross-sectional view showing the support bracket and the wheel axle are being assembled.

Referring to FIG. 4, during a process of rotating the wheel axle 30 in such a way to have the wheel axle 30 screwed to the internally threaded section 12, a portion of the wheel axle 30 other than the externally threaded section 31 has an outside diameter that generally matches the inside diameter of the axle hole 11 and may compress the retention ring 20 to cause deformation of the retention ring 10 for temporal retraction into the groove 13. Once the externally threaded section 31 of the wheel axle 30 is completely screwed into the internally threaded section 12, the retention ring 20 is allowed to resume the original shape to partially get into and engage the retention slot 32 to retain the wheel axle 30 in position.

As such, besides fixing an end portion of the wheel axle 30 in the axle hole 11 by means of threading engagement between the internally threaded section 12 and the externally threaded section 31, the present invention also provides the retention ring 20 in retaining engagement between the groove 13 and the retention slot 32, wherein a portion of the retention ring 20 is received in the groove 13 and another portion is received in the retention slot 32, whereby the end portion of the wheel axle 30 is retained in the axle hole 11 and is not axially movable, namely the wheel axle 30 is not separable. Further, the assembling structure of the support bracket 10 and the wheel axle 30 is completely concealed in the axle hole 11 and is not exposed.

Referring to FIG. 2, the retention ring 20 is made of metal and is in the form of a C-shape for undergoing predetermined deformation when compressed by the wheel axle 30 in order to facilitate the retention ring 20 to fit into the retention slot 32.

Referring to FIG. 5, when the wheel axle 30 is screwed into the axle hole 11, the groove 13 and the retention slot 32 correspond to each other in position to allow the retention ring 20 to be fit into the retention slot 32.

In summary, the present invention offers various advantages including improved stability of the skateboard, increased speed being available, safer and more precise operation, reduced manufacturing cost, being free of undesired separation of the wheel axle from the skateboard, and aesthetically improved outside appearance and can overcome the shortcoming of the conventional assembling structure of support bracket of skateboard and the wheel axle of the skateboard.

Figure 6:
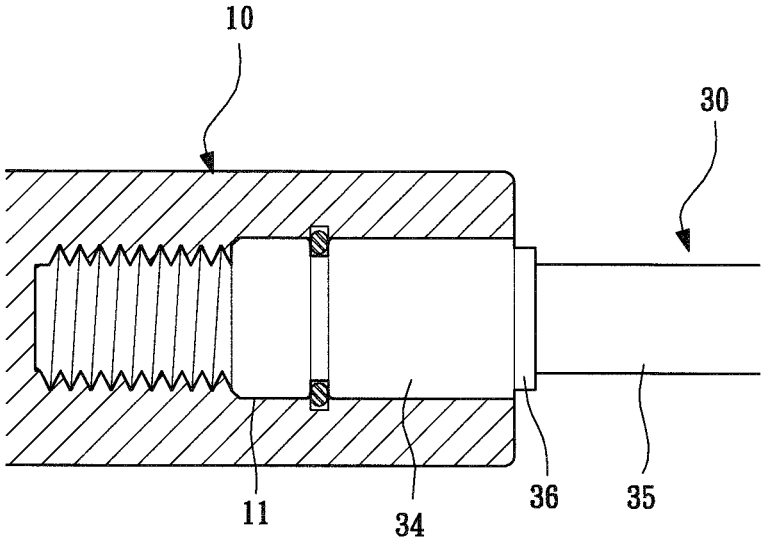
FIG. 6 is a cross-sectional view showing another embodiment of the wheel axle of the present invention.

Further, in a conventional skateboard, the wheel axle comprises a washer fit thereto. The purpose of the washer is to protect a bearing of the skateboard wheel axle from wearing and to facilitate smooth rotation of the bearing. Referring to FIG. 6, another embodiment of the wheel axle 30 according to the present invention comprises a first axle portion 34 and a second axle portion 35 having an outside diameter smaller than the first axle portion 34. A step 36 is integrally formed between the first axle portion 34 and the second axle portion 35.

As such, the step 36 may play the role of and replace the washer included in the conventional skateboard wheel axle. However, the present invention adopts an integrally formed arrangement, which besides providing the same effect of wear resistance and enhancement of bearing rotation as the conventional washer, may eliminate the cost of the washer and also save the time for assembling the washer (which leads to saving of the manufacturing cost).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An assembling structure of support bracket and wheel axle of skateboard, comprising:

a support bracket, which is mounted to an underside of the skateboard and comprises at least one axle hole, the axle hole comprising an internally threaded section and a groove formed at a predetermined location;

a retention ring, which is of predetermined elasticity for predetermined deformation; and a wheel axle, which has an end portion comprising an externally threaded section and a retention slot at a predetermined location and an opposite end portion adapted to couple to a wheel;

wherein the externally threaded section of the wheel axle is threadingly engageable with the internally threaded section of the axle hole in such a way that the retention ring is set in retaining engagement between the groove and the retention slot with a portion of the retention ring received in the groove and another portion received in the retention slot, so as to have the end portion of the wheel axle retained in the axle hole by means of threading engagement and retaining engagement without being axially movable.

2. The assembling structure of support bracket and wheel axle of skateboard according to claim 1, wherein the retention ring is made of metal and is in the form of a C-shape for undergoing predetermined deformation when compressed by the wheel axle in order to facilitate the retention ring to fit into the retention slot.

3. The assembling structure of support bracket and wheel axle of skateboard according to claim 1, wherein the wheel axle is threadingly coupled to the axle hole in such a way that the groove and the retention slot correspond to each other in position to allow the retention ring to be fit into the retention slot.

4. The assembling structure of support bracket and wheel axle of skateboard string according to claim 1, wherein the wheel axle comprises a first axle portion and a second axle portion having an outside diameter smaller than the first axle portion, a step being integrally formed between the first axle portion and the second axle portion.

* * * * *